US005835004A

United States Patent [19]

Gemperle et al.

[11] Patent Number: 5,835,004

[45] Date of Patent: Nov. 10, 1998

[54] ELECTRICAL DEVICES AND ASSEMBLIES

[75] Inventors: James P. Gemperle, Los Altos; Richard A. Herms, Newark; Bengt Nyman, San Diego; Irwin Zahn, Coronado, all of Calif.

[73] Assignee: Raychem Corporation, Menlo Park, Calif.

[21] Appl. No.: 426,773

[22] Filed: Apr. 21, 1995

[51] Int. Cl.[6] ..... H01C 3/06

[52] U.S. Cl. ..... 338/212; 338/22 R; 338/22 SD

[58] Field of Search ..... 338/22 R, 22 SD, 338/26, 48, 203–205, 207, 208, 210, 212; 29/628, 621

[56] References Cited

U.S. PATENT DOCUMENTS

| | | | |
|---|---|---|---|
| 3,061,501 | 10/1962 | Dittman et al. | 338/212 |
| 3,605,261 | 9/1971 | Zahn et al. | 29/628 |
| 3,927,453 | 12/1975 | Zahn et al. | 29/203 D |
| 3,991,452 | 11/1976 | Zahn et al. | 29/33 M |
| 4,067,105 | 1/1978 | Zahn et al. | 29/628 |
| 4,129,941 | 12/1978 | Zahn | 29/753 |
| 4,176,448 | 12/1979 | Zahn et al. | 29/626 |
| 4,230,387 | 10/1980 | Zahn | 339/59 M |
| 4,250,482 | 2/1981 | Kouchich et al. | 338/275 |
| 4,293,890 | 10/1981 | Varsane | 361/310 |
| 4,318,964 | 3/1982 | Zahn et al. | 428/572 |
| 4,320,176 | 3/1982 | Zahn | 428/573 |
| 5,089,801 | 2/1992 | Chan et al. | 338/22 R |
| 5,239,745 | 8/1993 | Hofsäss | 29/621 |

FOREIGN PATENT DOCUMENTS 59-63536 A 4/1984 Japan .

OTHER PUBLICATIONS

Search Report for International Application No. PCT/US96/05515, dated Aug. 2, 1996.

*Primary Examiner*—Tu B. Hoang
*Attorney, Agent, or Firm*—Timothy H. P. Richardson; Herbert G. Burkard

[57] ABSTRACT

Improved tape assemblies for delivering electrical devices to work stations at which the devices are installed. Each of the devices comprises a laminar electrical component sandwiched between two laminar metal members, and is preferably a PTC circuit protection device. In the assemblies, the electrical components are discrete components, but they are contacted by, and linked together through, laminar metal members which, after the assembly has been divided into separate devices, provide leads which contact and extend away from the electrical component. Preferably the metal members are prepared by cutting and forming a single strip of metal. Preferably the assembly is free from any longitudinally continuous carrier strip which much be discarded after the devices have been separated from each other. Preferably, the assemblies are sufficiently flexible to be wrapped around a reel and unwrapped at the work station.

18 Claims, 2 Drawing Sheets

ELECTRICAL DEVICES AND ASSEMBLIES

BACKGROUND OF THE INVENTION

1. Field of the Invention

This invention relates to electrical devices, and to flexible tape assemblies comprising a plurality of electrical devices to be delivered to a work station at which the devices are separated and installed. The invention is particularly useful for PTC circuit protection devices.

2. Introduction to the Invention

Many known electrical devices comprise a laminar electrical component which is sandwiched between two laminar metal members. Such devices include, for example, resistors, varistors, heaters and capacitors. Particularly useful devices of this type are PTC circuit protection devices. PTC (positive temperature coefficient) materials are well known and include conductive polymers (which generally comprise a crystalline organic polymer and, dispersed or otherwise distributed therein, a conductive filler, preferably carbon black) and conductive ceramics. U.S. Pat. Nos. 4,237,441, 4,238,812, 4,315,237, 4,317,027, 4,426,663, 4,545,926, 4,724,417, 4,774,024, 4,780,598, 4,845,838, 4,859,836, 4,907,340, 4,924,074, 4,935,156, 4,967,176, 5,049,850, 5,089,801 and 5,378,407 disclose known PTC conductive polymers, laminar PTC elements comprising PTC conductive polymers, and laminar electrical components comprising such PTC elements. Preferred electrodes for use with PTC conductive polymers are metal foils, particularly foils having a rough, preferably electrodeposited, surface which contacts the conductive polymer, as disclosed for example in U.S. Pat. Nos. 4,689,475 and 4,800,253. Preferred leads for use with PTC circuit protection devices include leads which are shaped to ensure that they do not inhibit expansion of the PTC element, as disclosed for example in U.S. Pat. No. 4,685,205.

Many different methods are known for installing electrical devices. In some methods, the devices, or components to make the devices, are supplied to a work station in the form of flexible tape assemblies comprising a plurality of the devices or components which are secured to a tape carrier; at the work station, the devices or components are separated and installed, and the tape carrier is discarded. Reference may be made, for example, to U.S. Pat. Nos. 5,148,596, 4,889,277 and 4,832,622, the disclosures of which are incorporated herein for all purposes.

SUMMARY OF THE INVENTION

We have discovered, in accordance with the present invention, improved tape assemblies which comprise a plurality of electrical devices, each of the devices comprising a laminar electrical component sandwiched between two laminar metal members. In these improved assemblies, the electrical components are discrete components, but they are contacted by, and linked together through, laminar metal members which, after the assembly has been divided into separate devices, provide leads which contact and extend away from the electrical component. Preferably the assembly is free from any longitudinally continuous carrier strip which much be discarded (or which serves no usefull purpose) after the devices have been separated from each other. Preferably, the assemblies are sufficiently flexible to be wrapped around a reel and unwrapped at the work station.

In a first preferred aspect, this invention provides an elongate tape assembly which can be divided transversely into a plurality of electrical devices, each of the devices comprising (1) a laminar electrical component having a first face and a second face;

(2) a first laminar metal lead which comprises (i) a contact portion which contacts the first face of the laminar electrical component, and (ii) an extending portion which does not contact the laminar electrical component; and (3) a second laminar metal lead which comprises (i) a contact portion which contacts the second face of the laminar electrical component, and (ii) an extending portion which does not contact the laminar electrical component;

said assembly comprising (A) a plurality of laminar metal lead-forming members which are spaced apart along the length of the assembly, each of said lead-forming members comprising (i) a first lead section which corresponds to the first lead of one device and (ii) a second lead section which corresponds to the second lead of an adjacent device; and (B) a plurality of laminar electrical components which are spaced apart along the length of the assembly and each of which is secured between the first lead section of one lead-forming member and the second lead section of the adjacent lead-forming member.

The laminar metal lead-forming members are preferably obtained by cutting and shaping a single strip of metal.

In a second preferred aspect, this invention provides an elongate tape assembly which can be divided transversely into a plurality of electrical devices, each of the devices comprising (1) a laminar electrical component having a first face and a second face;

(2) a first laminar metal lead which comprises (i) a contact portion which contacts the first face of the laminar electrical component, and (ii) an extending portion which does not contact the laminar electrical component; and (3) a second laminar metal lead which comprises (i) a contact portion which contacts the second face of the laminar electrical component, and (ii) an extending portion which does not contact the laminar electrical component;

said assembly comprising (A) a first laminar metal lead-forming member which (i) extends continuously along the length of the assembly, and (ii) comprises a plurality of first lead sections which correspond to the first leads of the devices; and either (a) a second laminar metal lead-forming member which (i) extends continuously along the length of the assembly and (ii) comprises a plurality of second lead sections which correspond to the second leads of the devices;

or (b) a plurality of second laminar metal lead-forming members which are spaced apart along the length of the assembly and each of which comprises a second lead section which corresponds to the second lead of one of the devices and (B) a plurality of laminar electrical components which are spaced apart along the length of the assembly and each of which is secured between a first lead section and a second lead section;

the first and second lead-forming members having been obtained by cutting and shaping a single strip of metal.

In a third preferred aspect, this invention provides a method of making an assembly as defined in the first preferred aspect of the invention, which method comprises (1) cutting and forming a continuous metal tape to provide (a) a plurality of lead-forming members, each of said lead-forming members comprising (i) a first lead section, and (ii) a second lead section, the first lead section of one lead-forming member longitudinally overlapping the second lead section of an adjacent lead-forming member and being displaced therefrom to form a holder for an electrical component, and (b) a plurality of linking members each of which joins an end of one lead-forming member to an intermediate portion of the adjacent lead-forming member;

and (2) placing a laminar electrical component in each of the holders.

In a fourth preferred aspect, this invention provides a method of making a plurality of articles, each of the articles including an electrical device comprising a laminar electrical component sandwiched between two laminar metal members, which method comprises (A) supplying an elongate tape assembly as defined in the first or second preferred aspect of the invention to a work station, (B) placing one end of the tape assembly at a desired location in the work station;

(C) cutting the assembly so that a terminal electrical device at the end of the tape assembly is separated from the remainder of the assembly; and (D) before or after step (C), securing the terminal electrical device to another component of the article;

and repeating said steps (A) to (D) to prepare the plurality of articles.

When an assembly as defined in the first preferred aspect of the invention is divided up, the resulting separate devices are novel products when, as is preferred, the lead-forming members have been obtained by cutting and shaping a single strip of metal. Similarly, when an assembly as defined in the second preferred aspect of the invention is divided up, the resulting separate devices are novel products. These novel devices form part of the present invention. Thus, a fifth preferred aspect of the invention provides an electrical device which comprises (1) a laminar electrical component having a first face and a second face;

(2) a first laminar metal lead which has (i) a contact portion which contacts a part only of the first face of the laminar electrical component, and (ii) an extending portion which does not contact the laminar electrical component; and (3) a second laminar metal lead which has (i) a contact portion which contacts a part only of the second face of the laminar electrical component, and (ii) an extending portion which does not contact the laminar electrical component;

the first and second metal leads having been obtained by cutting and shaping a single strip of metal.

A BRIEF DESCRIPTION OF THE DRAWING

The invention is illustrated in the accompanying drawings, in which

DETAILED DESCRIPTION OF THE INVENTION

Laminar Electrical Components

Figure 1:
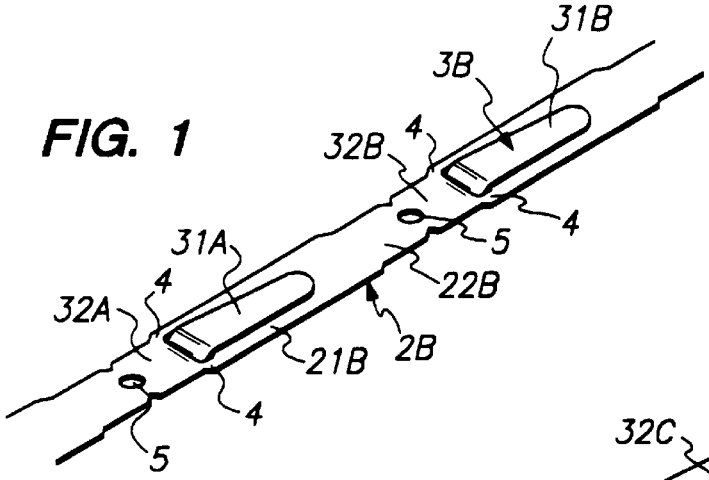
FIG. 1 is a perspective view of a metal strip into which laminar electrical components can be inserted to make an assembly as defined in the first preferred aspect of the invention.

The laminar electrical components used in the present invention can be of any kind. Often the component will comprise two outer layers of a relatively conductive material, preferably a metal, which provide substantially equipotential surfaces, and a functional non-metallic electrical component sandwiched between the two outer layers. The functional electrical component is often a single planar layer of constant thickness and uniform composition. But it can also be, for example, a single layer whose thickness or composition varies regularly or irregularly, continuously or discontinuously, from face to face and/or from side to side (including a layer comprising two or more components side by side), or two or more layers of the same or different thicknesses (which may be constant or varying) and of the same or different compositions.

The functional electrical component can, for example, be composed of an electrically insulating material (in which case the device is a capacitor), a conventional resistive material (the device then being a resistor), a voltage-dependent resistive material (the device then being a varistor) or a positive temperature coefficient (PTC) resistive material (the device then being a circuit protection device or a self-regulating heater). Often there will be a single electrical component in each device,, and all the components will be the same. However, each device can contain two or more electrical components connected in series or in parallel or (when there are three or more components) in series/parallel combinations.

The invention is particularly useful for PTC protection devices, especially those which comprise a PTC element which is composed of a PTC conductive polymer comprising (a) a polymeric component which comprises a crystalline organic polymer and (b) dispersed or otherwise distributed in the polymeric component, at least one particulate electrically conductive filler, preferably carbon black. Laminar electrical components containing a PTC conductive polymer often comprise (a) a laminar resistive element which (i) is composed of a conductive polymer exhibiting PTC behavior, and (ii) has a first surface and a second surface;

(b) a first laminar metal electrode having (i) an inner surface which contacts the first surface of the resistive element, and (ii) an outer surface which contacts the first metal lead; and (c) a second laminar metal electrode having (i) an inner surface which contacts the second surface of the resistive element and (ii) an outer surface which contacts the second metal lead.

The resistance of such a component is often less than 1 ohm and can be less than 0.1 ohm. The metal electrodes in such components are preferably metal foils, particularly foils having a rough, preferably electrodeposited, surface which contacts the conductive polymer. The metal foil can, for example, be composed of copper, or nickel, or copper which is plated, at least on the surface which contacts the conductive polymer, with nickel or another material which at least partially prevents the copper from contacting the conductive polymer. Suitable metal foils for use in this invention include those disclosed in U.S. Pat. Nos. 4,689,475 and 4,800,253, and copending commonly assigned U.S. application Ser. No. 08/255,584 (Docket No. MP1505), the disclosures of which are incorporated herein by reference, and to which reference should be made for details.

PTC conductive polymers, laminar PTC elements comprising PTC conductive polymers, and laminar electrical components comprising such PTC elements, suitable for use in this invention, are described in detail in U.S. Pat. Nos. 4,237,441, 4,238,812, 4,315,237, 4,317,027, 4,426,633, 4,545,926, 4,724,417, 4,774,024, 4,780,598, 4,845,838, 4,859,836, 4,907,340, 4,924,074, 4,935,156, 4,967,176, 5,049,850, 5,089,801 and 5,378,407, and copending commonly assigned U.S. application Ser. No. 07/462,893, Docket No. MP1039, the disclosures of which are incorporated herein by reference and to which reference should be made for details.

The laminar electrical component may, for example, have an average thickness of 0.002 to 0.25 inch, preferably 0.004 to 0.1 inch, e.g. 0.006 to 0.050 inch, and be of any appropriate shape, e.g. round, square or rectangular, with an area (viewed at right angles to the plane of the component) of 0.03 to 0.5, e.g. 0.05 to 0.25, $inch^2$.

Laminar Metal Leads

The laminar metal leads can be of any appropriate metal and thickness, for example, nickel foil having a thickness of 0.02 to 0.100 inch. The leads should, of course, have an adequate current-carrying capacity for the intended purpose of the device, and, at least in the case of PTC protection devices, the extent to which they can remove heat from the PTC element can also be important. The contact portions of the leads should contact a high enough proportion of the laminar electrical component to provide adequate physical and electrical contact, e.g. at least 10%, preferably at least 25% of the area thereof. When (as is preferred) the leads are formed by cutting a single strip of metal, then the contact portions of the first and second leads will generally not overlap when the assembly (or device) is viewed in plan, and each preferably contacts 10 to 70%, e.g. 40 to 60%, of the area of the electrical component.

The extending portions of the first and second leads will generally extend away from the laminar electrical component in opposite directions. They can be straight and of a simple rectangular shape. They can also be of a more complex shape and/or be bent, before or after the device has been separated from the assembly, in order to provide leads which can be more easily installed or which have some desired property after installation. For example, one or more of the leads can have a narrowed portion which can act as a meltable fuse, or can have a channel or hole to help in locating the device during assembly, or can be shaped so as to ensure that the leads do not transmit undesirable forces to the electrical component, e.g. compressive forces which would inhibit the expansion of the PTC element (suitable expedients for this last purpose are disclosed, for example, in U.S. Pat. No. 4,685,025, the disclosure of which is incorporated herein by reference).

Laminar Metal Lead-forming Members

The metal leads in the separated devices correspond to all or part of the lead-forming members in the assemblies. In the first preferred aspect of the invention each of the lead-forming members comprises (i) a first lead section which corresponds to (i.e. which, after the assembly has been divided up, becomes) the first lead of one device, and (ii) a second lead section which corresponds to the second lead of the adjacent device. Thus the leads extend longitudinally in the assembly. Generally the first lead section of one lead-forming member and the second lead section of the adjacent lead-forming member will overlap longitudinally and be displaced from each other so as to form a holder within which the electrical component is secured, preferably by means of solderjoints. In the assemblies which are ready for use in an installation process, the lead-forming members are preferably joined to each other only through the laminar electrical components, so that a device can be removed from the end of the assembly merely by cutting through a center section of the lead-forming member. In the preparation of such assemblies from a single piece of metal, there will usually be intermediate assemblies in which there are metal linking members which are integral with the lead-forming members and each of which joins the end of one lead-forming member to an intermediate portion of the adjacent lead-forming member. These metal linking members must be removed before the devices can be used. They are preferably cut out before the assembly is rolled up on a reel, ready for use when required. Alternatively, they can be cut out at the time of installation.

In the second preferred aspect of the invention, at least one of the lead-forming members extends continuously along the length of the assembly (and thus provides the assembly with longitudinal integrity) and comprises a plurality of first lead sections which correspond to the first leads of the devices and extend transversely across the assembly. The second leads are provided by another lead-forming member which also extends continuously along the length of the assembly, or by a plurality of separate lead-forming members, each corresponding to one of the second leads.

Method of Preparing the Assemblies

The assemblies used in this invention can be prepared in any suitable way, but are preferably prepared by cutting and shaping a single piece of metal tape so that it provides the lead-forming members in the desired configuration, i.e. a configuration which includes holders into which the electrical components can be inserted. For example, the first lead section can be in the form of a fork having two arms, and the second lead section of the adjacent lead-forming member can be in the form of a finger which lies between the arms of the fork but is displaced from them. The finger and the arms of the fork can be spring-biased towards each other, thus forming a clip which secures the electrical component removably in place, at least until the lead sections are permanently attached to the electrical component, e.g. by a solder bond.

After the electrical components have been inserted into the holders, and the linking members have been removed, the assembly can be covered wholly or partially with an insulating material. The insulating material may also increase the structural stability of the assembly during storage and use, and the structural stability of the device after it has been installed. The insulating material can be applied, for example, by means of a tape wrap, overmolding, or powder coating.

DETAILED DESCRIPTION OF THE DRAWINGS

Referring now to the drawings, FIG. 1 shows a portion of a strip of metal which has been cut and shaped so that it provides a plurality of identical longitudinally spaced laminar metal lead-forming members. FIG. 1 shows one of the lead-forming members in full and part only of the adjacent lead forming members. The lead-forming member shown in full comprises a first lead section 2B and a second lead section 3B. The first lead section 2B comprises a fork-shaped contact portion 21B and an extending portion 22B. The second lead section 3B comprises a finger-shaped contact portion 31B and an extending portion 32B. The ends of the fork-shaped contact portion 21B are connected to the junction of finger-shaped contact portion 31A and extending portion 32A of the adjacent lead-forming member through linking members 4. Registration holes 5 are also formed in the strip.

Figure 2:
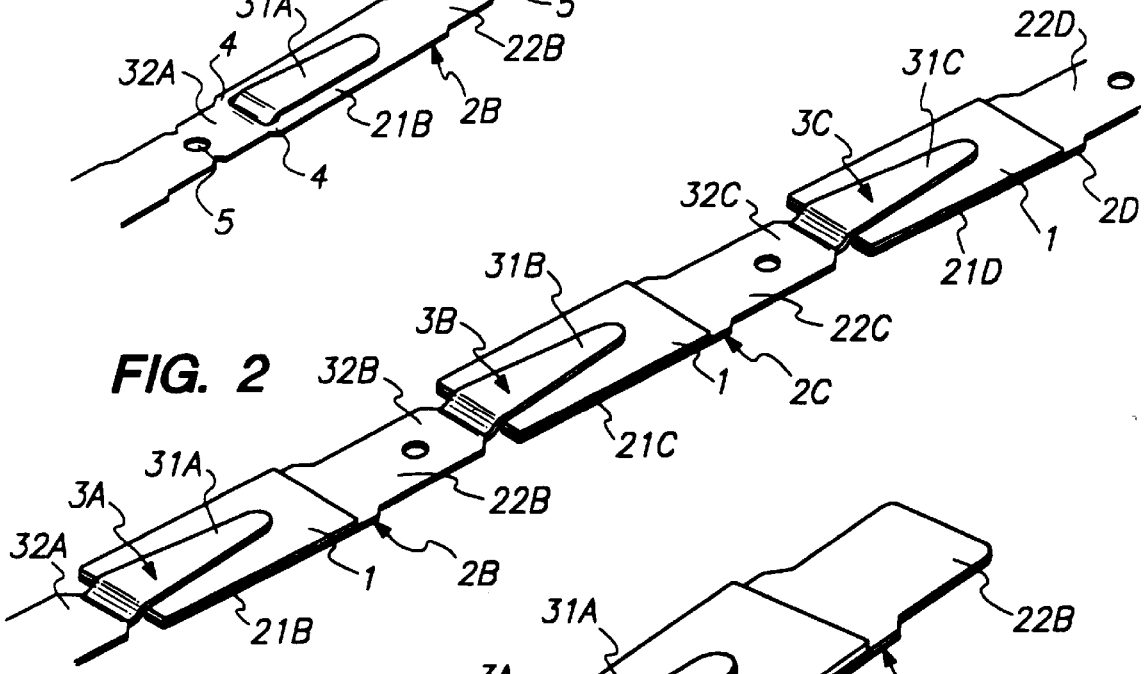
FIG. 2 is a perspective view of an assembly as defined in the first preferred aspect of the invention.
Figure 3:
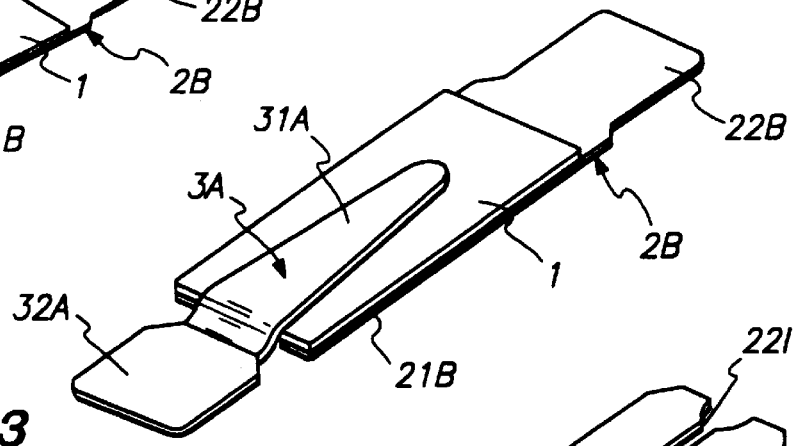
FIGS. 3 and 4 are perspective views of electrical devices of the invention.

A metal tape as shown in FIG. 1 can be converted into an assembly as shown in FIG. 2 by inserting laminar electrical components into the holders formed by contact portions 21B and 31A; soldering (or otherwise securing) the contact portions to the laminar electrical component; and removing the linking members 4. An assembly as shown in FIG. 2 can be severed between the extending portions 22B and 32B, etc., to provide electrical devices as shown in FIG. 3. The device of FIG. 3 has been prepared by making two transverse cuts which cut out the registration hole 5, but the cutting could have been by a single transverse cut through the hole 5.

Figure 4:
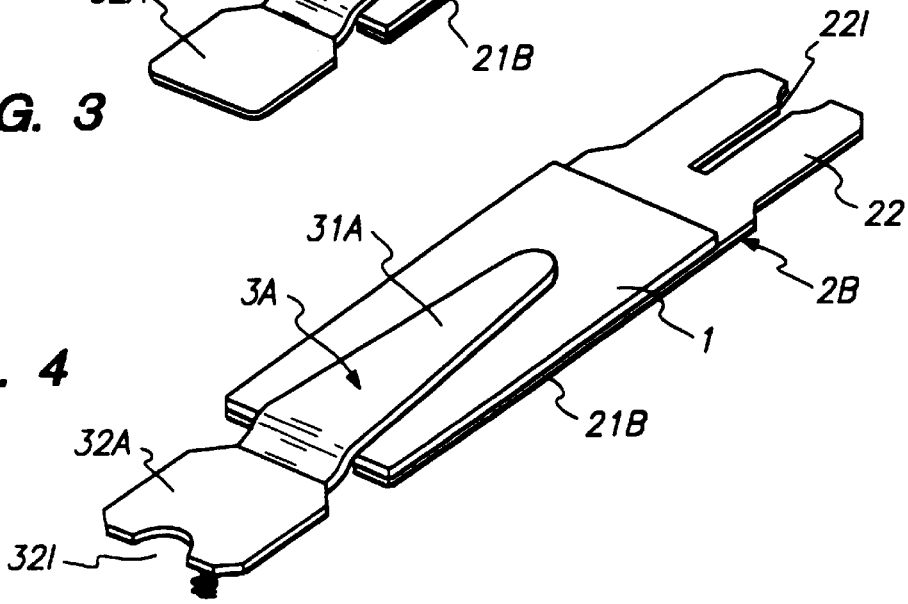

FIG. 4 is similar to FIG. 3 but shows in addition extending portions which have locating recesses 221 and 321 to assist in installation.

Figure 5:
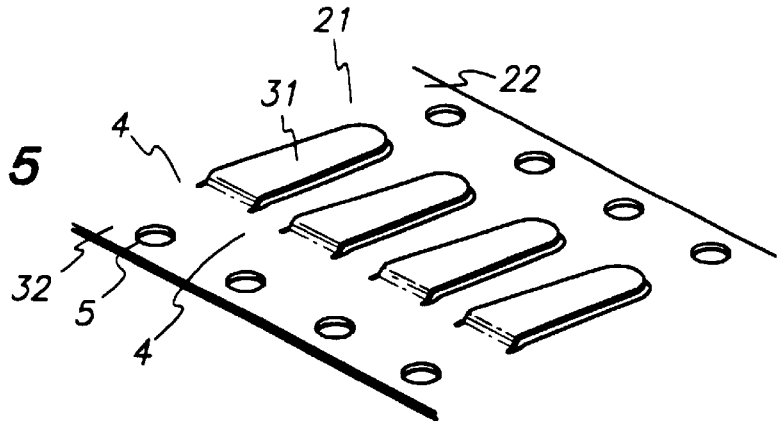
FIG. 5 is a perspective view of a metal strip into which laminar electrical components can be inserted to make an assembly according to the second preferred aspect of the invention.

FIG. 5 (which uses the same reference numerals as FIG. 1 to denote like parts) shows a metal carrier strip which becomes an assembly as defined in the second preferred aspect of the invention when electrical components are placed in the holders formed by contact portions 21 and 31.

Figure 6:
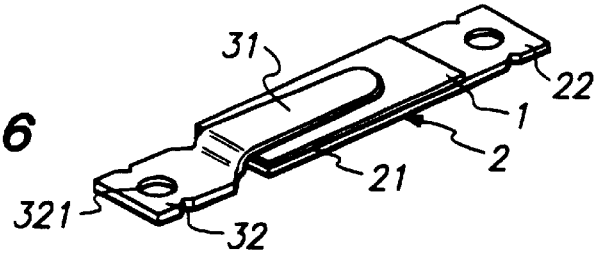
FIGS. 6 to 9 are perspective views of electrical devices of the invention.

FIG. 6 shows a device obtained by cutting the assembly of FIG. 5 transversely.

Figure 7:
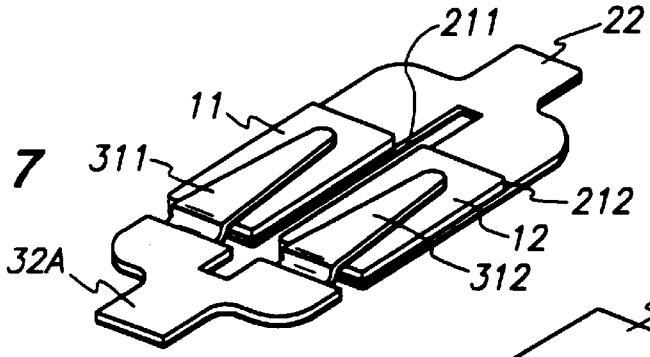

FIG. 7 shows another device of the invention which comprises electrical components 11 and 12 which, in use, will be connected electrically in parallel with each other. The area between extending portions 32A and 22 has been divided longitudinally into two parts, each part having a finger-shaped contact portion (311, 312) and a fork-shaped contact portion (211, 212), to provide separate holders for the electrical components.

Figure 8:
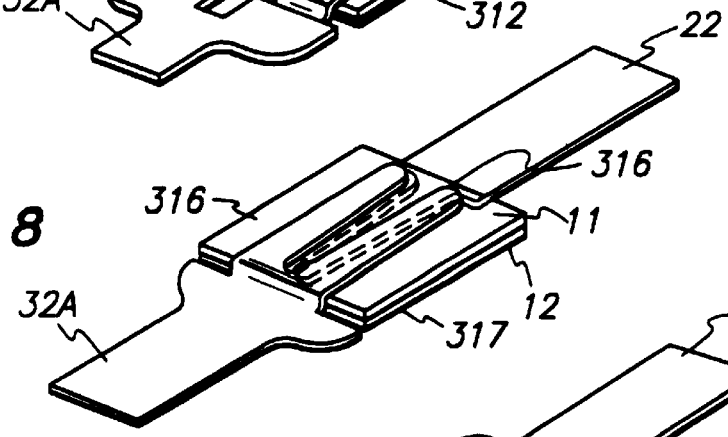
Figure 9:
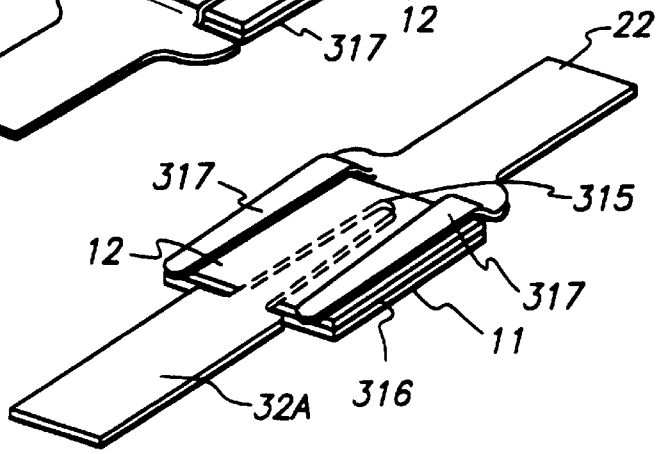

FIGS. 8 and 9 show top and bottom views of another device of the invention which also comprises electrical components 11 and 12 which, in use, will be connected electrically in parallel with each other. The area between the extending portions 32A and 22 has been cut to form a central finger-shaped contact portion 315 (shown by a dotted line) and two fork-shaped contact portions 316, 317 which are bent so that they form holders with the portion 315 for the components 11 and 12.

EXAMPLE

Using a progressive stamping tool, a strip of nickel 200, about 0.005 inch thick and about 0.2 inch wide, was lanced and formed into a strip generally as shown in FIG. 1. The distance between the holes 5 was about 0.85 inch. The finger-shaped portion 31 was about 0.4 inch long and about 0.12 inch wide, and was angled slightly downwards so as to create a spring clip for retention of a laminar electrical component to be inserted later. The strip was transferred to another machine which inserted laminar electrical components into the holders formed by the portions 21 and 31. Each electrical component (I) was rectangular in shape, with sides of about 0.47 inch and about 0.2 inch, (ii) had a thickness of about 0.02 inch, (iii) consisted of two electrodeposited nickel or nickel-plated copper foil electrodes, a laminar PTC conductive polymer element sandwiched between the foils, and a layer of solder on the outside of each foil, and (iv) had a resistance at 21° C. of about 70 milliohms. The portions 21 and 31 and the outside of each foil were fluxed, and the assembly heated to about 220° C. to solder the PTC component to the portions 21 and 31. The linking members were punched out, using a punch about 0.035 by 0.035 inch, and the assembly was wrapped with insulating polyester tape. Individual devices were prepared by cutting the assembly transversely to give devices as shown in FIG. 3.

A similar assembly was prepared with the distance between the holes 5 being about 1.1 inch, the finger-shaped portion being about 0.3 inch long and about 0.12 inch wide, the laminar PTC conductive polymer element being about 0.47×0.2×0.01 inch and having a resistance at 21° C. of about 40 milliohms, and the linking members being about 0.045×0.06 inch.

What is claimed is:

1. An elongate tape assembly which can be divided transversely into a plurality of electrical devices, each of the devices comprising (1) a laminar electrical component having a first face and a second face;

(2) a first laminar metal lead which comprises
  (i) a contact portion which contacts the first face of the laminar electrical component, and
  (ii) an extending portion which does not contact the laminar electrical component; and (3) a second laminar metal lead which comprises
  (i) a contact portion which contacts the second face of the laminar electrical component, and
  (ii) an extending portion which does not contact the laminar electrical component;

said assembly comprising (A) a plurality of laminar metal lead-forming members which are spaced apart along the length of the assembly, each of said lead-forming members comprising (i) a first lead section which corresponds to the first lead of one device and (ii) a second lead section which corresponds to the second lead of an adjacent device; and (B) a plurality of laminar electrical components which are spaced apart along the length of the assembly and each of which is secured between the first lead section of one lead-forming member and the second lead section of the adjacent lead-forming member.

2. An assembly according to claim 1 wherein the lead-forming members have been obtained by cutting and shaping a single strip of metal, and the first lead section of one lead-forming member longitudinally overlaps the second lead section of the adjacent lead-forming member.

3. An assembly according to claim 2 wherein the lead-forming members are substantially identical to each other, each of the first lead sections is in the form of a fork having two longitudinally extending arms, and each of the second lead sections is in the form of a longitudinally extending finger which lies between the arms of the fork when the assembly is viewed in plan and is displaced from the arms of the fork when the assembly is viewed from the side.

4. An assembly according to claim 2 which comprises a plurality of metal linking members each of which (a) joins an end of a lead-forming member to an intermediate portion of the adjacent lead-forming member and (b) must be removed in order to convert the assembly into a plurality of devices, the lead-forming members and the metal linking members together constituting the only longitudinally continuous component of the assembly.

5. An assembly according to claim 2 in which the adjacent lead-forming members are connected to each other only through the laminar electrical components, and which does not contain any longitudinally continuous component.

6. An assembly according to claim 1 wherein each of the laminar electrical components comprises (a) a laminar resistive element which (i) is composed of a conductive polymer exhibiting PTC behavior and (ii) has a first surface and a second surface;

(b) a first laminar metal electrode having (i) an inner surface which contacts the first surface of the resistive element, and (ii) an outer surface which contacts the first metal lead; and (c) a second laminar metal electrode having (i) an inner surface which contacts the second surface of the resistive element, and (ii) an outer surface which contacts the second metal lead.

7. An elongate tape assembly which can be divided transversely into a plurality of electrical devices, each of the devices comprising (1) a laminar electrical component having a first face and a second face;

(2) a first laminar metal lead which comprises (i) a contact portion which contacts the first face of the laminar electrical component, and (ii) an extending portion which does not contact the laminar electrical component; and (3) a second laminar metal lead which comprises (i) a contact portion which contacts the second face of the laminar electrical component, and (ii) an extending portion which does not contact the laminar electrical component;

said assembly comprising (A) a first laminar metal lead-forming member which (i) extends continuously along the length of the assembly, and (ii) comprises a plurality of first lead sections which correspond to the first leads of the devices; and either (a) a second laminar metal lead-forming member which (i) extends continuously along the length of the assembly and (ii) comprises a plurality of second lead sections which correspond to the second leads of the devices;

or (b) a plurality of second laminar metal lead-forming members which are spaced apart along the length of the assembly and each of which comprises a second lead section which corresponds to the second lead of one of the devices and (B) a plurality of laminar electrical components which are spaced apart along the length of the assembly and each of which is secured between a first lead section and a second lead section;

the first and second lead-forming members having been obtained by cutting and shaping a single strip of metal.

8. A method of making an electrical assembly as defined in claim 1 which comprises (1) cutting and forming a continuous metal tape to provide (a) a plurality of laminar lead-forming members, each of said lead-forming members comprising (i) a first lead section, and (ii) a second lead section, the first lead section of one lead-forming member longitudinally overlapping the second lead section of an adjacent lead-forming member and being displaced therefrom to form a holder for an electrical component, and (b) a plurality of linking members each of which joins an end of one lead-forming member to an intermediate portion of the adjacent lead-forming member;

and (2) placing a laminar electrical component in each of the holders.

9. A method according to claim 8 wherein the laminar electrical component comprises (a) a laminar resistive element which is composed of a conductive polymer exhibiting PTC behavior and which has a first surface and a second surface, (b) a first laminar metal electrode having (i) an inner surface which contacts the first surface of the resistive element, and (ii) an outer surface; and (c) a second laminar metal electrode having (i) an inner surface which contacts the second surface of the resistive element, and (ii) an outer surface;

and which includes, after step (2), (3) forming solder joints between the first electrodes and the first lead members and between the second electrodes and the second lead members.

10. A method according to claim 9 which includes (4) removing the linking members so that the adjacent lead-forming members are connected to each other only through the laminar electrical components.

11. A method of making a plurality of articles, each of said articles including an electrical device comprising (1) a laminar electrical component having a first face and a second face;

(2) a first laminar metal lead which has (i) a contact portion which contacts a part only of the first face of the laminar electrical component, and (ii) an extending portion which extends away from the laminar electrical component; and (3) a second laminar metal lead which has (i) a contact portion which contacts a part only of the second face of the laminar electrical component, and (ii) an extending portion which extends away from the laminar electrical component;

which method comprises (A) supplying an elongate tape assembly as claimed in claim 1 to a work station;

(B) placing one end of the tape assembly at a desired location in the work station;

(C) cutting the assembly so that a terminal electrical device at the end of the tape assembly is separated from the remainder of the assembly; and (D) before or after step (C), securing the terminal electrical device to another component of the article;

and repeating said steps (A) to (D) to prepare the plurality of articles.

12. An electrical device which comprises (1) a laminar electrical component having a first face and a second face;

(2) a first laminar metal lead which has (i) a contact portion which contacts a part only of the first face of the laminar electrical component, and (ii) an extending portion which does not contact the laminar electrical component; and (3) a second laminar metal lead which has (i) a contact portion which contacts a part only of the second face of the laminar electrical component, and (ii) an extending portion which does not contact the laminar electrical component;

the first and second metal leads having been obtained by cutting and shaping a single strip of metal.

13. A device according to claim 12 wherein the laminar electrical component comprises (a) a laminar resistive element having a first surface and a second surface;

(b) a first laminar metal electrode having (i) an inner surface which contacts the first surface of the resistive element, and (ii) an outer surface which is soldered to the contact portion of the first lead; and (c) a second laminar metal electrode having (i) an inner surface which contacts the second surface of the resistive element, and (ii) an outer surface which is soldered to the contact portion of the second lead.

14. A device according to claim 13 wherein the resistive element is composed of a material exhibiting non-linear resistivity behavior.

15. A device according to claim 12 wherein the resistive element is composed of a conductive polymer exhibiting PTC behavior.

16. A device according to claim 12 which comprises n laminar electrical components having a first face and a second face, where n is 2 or more; a first laminar metal lead which has (i) a contact portion which contacts a part only of the second face of each of the laminar electrical components, and (ii) an extending portion which does not contact any of the laminar electrical components;

and n second laminar metal leads, each of which has (i) a contact portion which contacts a part only of the second face of one only of the electrical components, and (ii) an extending portion which does not contact any of the electrical components.

17. A device according to claim 16 wherein each of the electrical components comprises a laminar electrical element composed of a conductive polymer exhibiting PTC behavior.

18. A device according to claim 16 wherein at least one of the laminar metal leads includes a fuse portion whose current-carrying capacity is less than the remainder of the lead.

* * * * *